US009380388B2

(12) United States Patent
Bazarjani et al.

(10) Patent No.: US 9,380,388 B2
(45) Date of Patent: Jun. 28, 2016

(54) CHANNEL CROSSTALK REMOVAL

(71) Applicant: QUALCOMM Incorporated, San Diego, CA (US)

(72) Inventors: Seyfollah S Bazarjani, San Diego, CA (US); Arash Mehrabi, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 834 days.

(21) Appl. No.: 13/629,855

(22) Filed: Sep. 28, 2012

(65) Prior Publication Data

US 2014/0093109 A1 Apr. 3, 2014

(51) Int. Cl.

| | |
|---|---|
| ***G06F 17/00*** | (2006.01) |
| ***H04R 5/04*** | (2006.01) |
| ***H04S 1/00*** | (2006.01) |

(52) U.S. Cl.

CPC .. *H04R 5/04* (2013.01); *H04S 1/00* (2013.01); *H04S 1/005* (2013.01)

(58) Field of Classification Search

CPC ..... H04R 5/04; H04S 1/00; H04S 1/005
See application file for complete search history.

(56) References Cited

U.S. PATENT DOCUMENTS

| | | | | |
|---|---|---|---|---|
| 6,243,476 | B1 * | 6/2001 | Gardner | 381/303 |
| 7,634,093 | B2 | 12/2009 | McGrath | |
| 7,925,030 | B2 | 4/2011 | Holmstrom et al. | |
| 7,936,887 | B2 | 5/2011 | Smyth | |
| 8,189,410 | B1 * | 5/2012 | Morton | G11C 7/06 365/189.011 |
| 2008/0008325 | A1 * | 1/2008 | Holmstrom | H04S 1/00 381/11 |
| 2008/0085010 | A1 | 4/2008 | Suzuki | |
| 2008/0159567 | A1 | 7/2008 | Lesso et al. | |
| 2010/0322428 | A1 | 12/2010 | Fukui et al. | |

FOREIGN PATENT DOCUMENTS

| | | | |
|---|---|---|---|
| EP | 2487931 | A2 | 8/2012 |

OTHER PUBLICATIONS

International Search Report and Written Opinion—PCT/US2013/062464—ISA/EPO—Jan. 16, 2014.

* cited by examiner

*Primary Examiner* — Fan Tsang
*Assistant Examiner* — Eugene Zhao
(74) *Attorney, Agent, or Firm* — Rupit M. Patel

(57) ABSTRACT

Techniques for removing crosstalk from a system, e.g., an audio system, having first and second (e.g., left and right) channels. In an aspect, first and second output voltages of corresponding first and second amplifiers are sampled during a calibration mode, in which one of the amplifiers is driven with a reference voltage, and the output of the other of the amplifiers is configured to have a high impedance. The sampled first and second output voltages may be digitized for processing by a processor to estimate a crosstalk removal function. The crosstalk removal function may then be multiplied with the input signals and added in a cross-channel manner to the first and second input signals prior to amplification to remove crosstalk from the system. In certain aspects, multiple reference voltages may be applied during the calibration mode to improve the estimate of the crosstalk removal function.

20 Claims, 10 Drawing Sheets

CHANNEL CROSSTALK REMOVAL

BACKGROUND

1. Field

The disclosure relates to media devices, and, in particular, techniques for removing crosstalk between channels caused by ground resistance in a media device.

2. Background

Audio and other media devices often include a jack for receiving a media plug coupled to a peripheral device. For example, a mobile phone may include a jack for receiving a plug coupled to an audio headset with microphone, which allows a user to carry on a voice conversation over the mobile phone using the headset. Other example media devices include MP3 players, handheld gaming devices, tablets, personal computers, notebook computers, personal digital assistants, etc., while other peripheral devices include headphones, hearing-aid devices, personal computer speakers, home entertainment stereo speakers, etc.

Stereo headphones often have a finite resistance in their ground path that is common to both the left and right channels. This finite ground resistance may cause crosstalk between the left and right channels of a stereo headphone, i.e., the left channel signal may be present on the right channel, and vice versa. For example, assuming 16 mΩ of ground resistance in a 16-Ω stereo headphone, the right channel signal will appear in the left channel attenuated by a factor of 1000 (−60 dB), and the left channel signal will appear in the right channel attenuated by a factor of 1000 (−60 dB). Thus, there will be as much as −60 dB of crosstalk present.

It would be desirable to provide simple and effective techniques for eliminating crosstalk between the left and right channels of a stereo system.

DETAILED DESCRIPTION

Various aspects of the disclosure are described more fully hereinafter with reference to the accompanying drawings. This disclosure may, however, be embodied in many different forms and should not be construed as limited to any specific structure or function presented throughout this disclosure.

Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The detailed description set forth below in connection with the appended drawings is intended as a description of exemplary aspects of the invention and is not intended to represent the only exemplary aspects in which the invention can be practiced. The term "exemplary" used throughout this description means "serving as an example, instance, or illustration," and should not necessarily be construed as preferred or advantageous over other exemplary aspects. The detailed description includes specific details for the purpose of providing a thorough understanding of the exemplary aspects of the invention. It will be apparent to those skilled in the art that the exemplary aspects of the invention may be practiced without these specific details. In some instances, well-known structures and devices are shown in block diagram form in order to avoid obscuring the novelty of the exemplary aspects presented herein.

Figure 1:
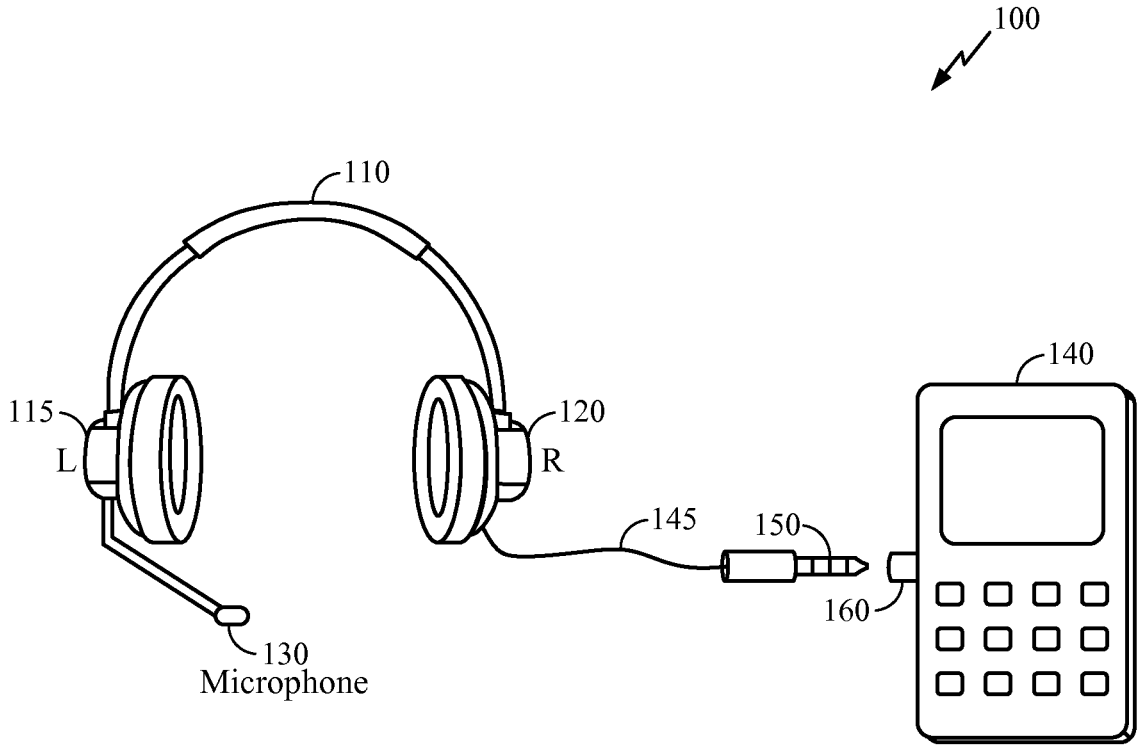
PRIOR ART FIG 1
FIG. 1 illustrates an exemplary scenario wherein the techniques of the present disclosure may be applied.

FIG. 1 illustrates an audio system 100 wherein the techniques of the present disclosure may be applied. It will be appreciated that FIG. 1 is shown for illustrative purposes only, and is not meant to limit the scope of the present disclosure to the particular system shown. For example, it will be appreciated that the techniques disclosed herein may also be readily applied to audio devices other than those shown in FIG. 1. Furthermore, the techniques may also be readily adapted to other types of multi-media devices, as well as to non-audio media devices, e.g., to remove crosstalk in plugs supporting video, etc., wherein two or more channels share a common series resistive path. Such alternative exemplary embodiments are contemplated to be within the scope of the present disclosure.

In FIG. 1, a headset 110 includes a left (L) headphone 115, a right (R) headphone 120, and a microphone 130. These components of the headset 110 are electrically coupled to terminals of a plug 150 via sheathed conducting wires 145. The plug 150 is insertable into a jack 160 of a media device 140. Note the jack 160 need not extrude from the surface of the device 140 as suggested by FIG. 1, and furthermore, the sizes of the elements shown in FIG. 1 are not necessarily drawn to scale. The device 140 may be, for example, a mobile phone, MP3 player, home stereo system, etc.

Audio and/or other signals may be exchanged between the device 140 and the headset 110 through the plug 150 and jack 160. The plug 150 receives the audio signals from the jack 160, and routes the signals to the L and R headphones of the headset 110. The plug 150 may further couple an electrical signal with audio content generated by the microphone 130 to the jack 160, and the microphone signal may be further processed by the device 140. Note the plug 150 may include further terminals not shown, e.g., for communicating other types of signals such as control signals, video signals, etc.

Figure 2:
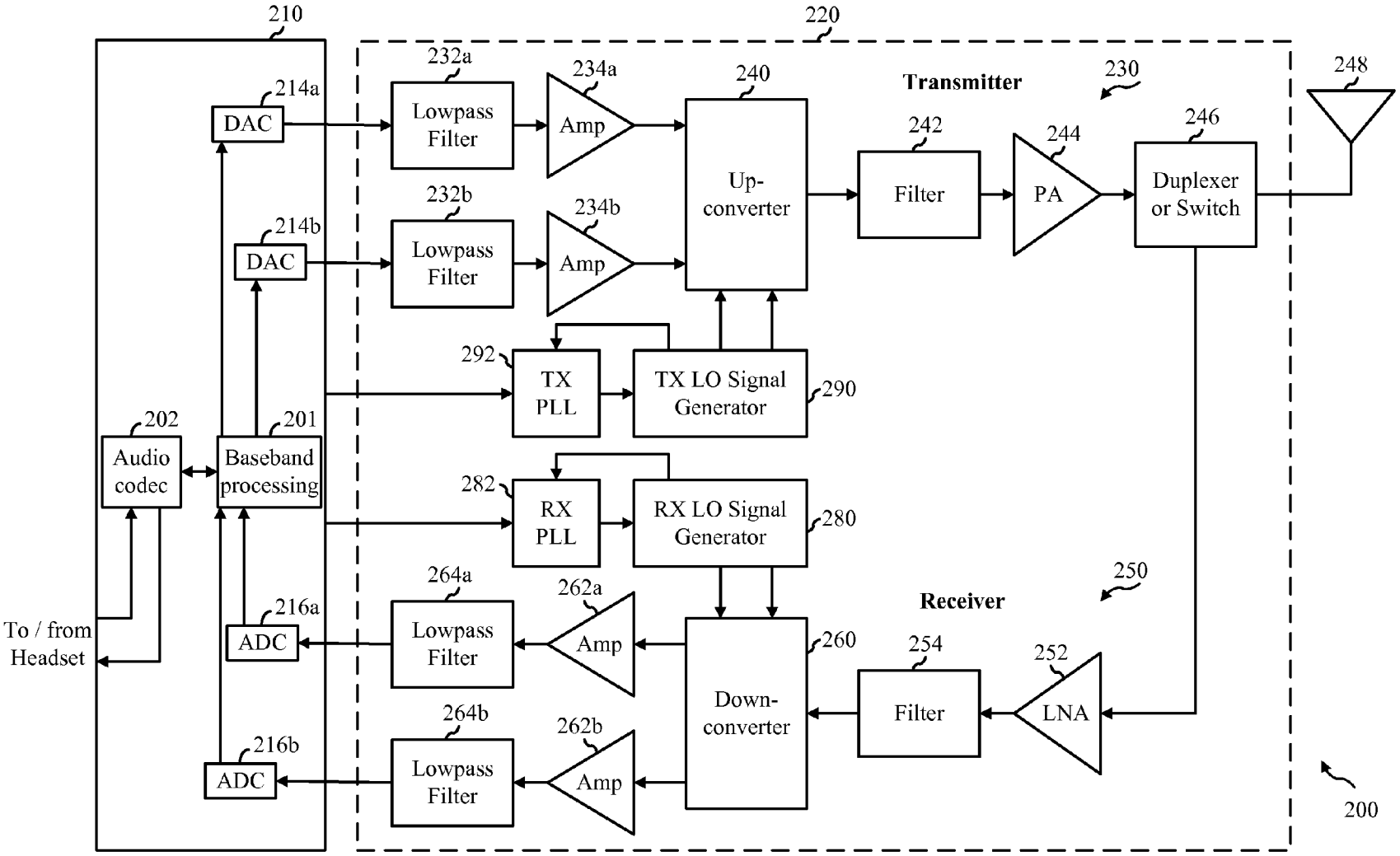
FIG 2 PRIOR ART
FIG. 2 illustrates a block diagram of wireless communications circuitry in which the techniques of the present disclosure may be implemented.

FIG. 2 illustrates a block diagram of wireless communications circuitry 200 in which the techniques of the present disclosure may be implemented. The circuitry 200 may correspond to, e.g., circuitry implemented in the media device 140 shown in FIG. 1. Note FIG. 2 is provided for illustrative purposes only, and is not meant to restrict the scope of the present disclosure to only wireless communication devices implementing the crosstalk elimination techniques disclosed herein. In alternative exemplary embodiments, the techniques disclosed herein may be implemented in an audio or other multi-media system without the radio transmit and receive elements shown in FIG. 2, and such alternative exemplary embodiments are contemplated to be within the scope of the present disclosure.

FIG. 2 shows an example transceiver design. In general, the conditioning of the signals in a transmitter and a receiver may be performed by one or more stages of amplifier, filter, upconverter, downconverter, etc. These circuit blocks may be arranged differently from the configuration shown in FIG. 2. Furthermore, other circuit blocks not shown in FIG. 2 may also be used to condition the signals in the transmitter and receiver. Some circuit blocks in FIG. 2 may also be omitted.

In the design shown in FIG. 2, wireless circuitry 200 includes a transceiver 220 and a data processor 210. The data processor 210 may include a memory (not shown) to store data and program codes. Transceiver 220 includes a transmitter 230 and a receiver 250 that support bi-directional communication. In general, wireless circuitry 200 may include any number of transmitters and any number of receivers for any number of communication systems and frequency bands. All or a portion of transceiver 220 may be implemented on one or more analog integrated circuits (ICs), RF ICs (RFICs), mixed-signal ICs, etc.

A transmitter or a receiver may be implemented with a super-heterodyne architecture or a direct-conversion architecture. In the super-heterodyne architecture, a signal is frequency converted between radio frequency (RF) and baseband in multiple stages, e.g., from RF to an intermediate frequency (IF) in one stage, and then from IF to baseband in another stage for a receiver. In the direct-conversion architecture, a signal is frequency converted between RF and baseband in one stage. The super-heterodyne and direct-conversion architectures may use different circuit blocks and/or have different requirements. In the design shown in FIG. 2, transmitter 230 and receiver 250 are implemented with the direct-conversion architecture.

In the transmit path, data processor 210 processes data to be transmitted and provides I and Q analog output signals to transmitter 230. In the exemplary embodiment shown, the data processor 210 includes digital-to-analog-converters (DAC's) 214*a* and 214*b* for converting digital signals generated by the data processor 210 into I and Q analog output signals, e.g., I and Q output currents, for further processing.

Within transmitter 230, lowpass filters 232*a* and 232*b* filter the I and Q analog output signals, respectively, to remove undesired images caused by the prior digital-to-analog conversion. Amplifiers (Amp) 234*a* and 234*b* amplify the signals from lowpass filters 232*a* and 232*b*, respectively, and provide I and Q baseband signals. An upconverter 240 upconverts the I and Q baseband signals with I and Q transmit (TX) local oscillating (LO) signals from a TX LO signal generator 290 and provides an upconverted signal. A filter 242 filters the upconverted signal to remove undesired images caused by the frequency upconversion as well as noise in a receive frequency band. A power amplifier (PA) 244 amplifies the signal from filter 242 to obtain the desired output power level and provides a transmit RF signal. The transmit RF signal is routed through a duplexer or switch 246 and transmitted via an antenna 248.

In the receive path, antenna 248 receives signals (e.g., transmitted by base stations) and provides a received RF signal, which is routed through duplexer or switch 246 and provided to a low noise amplifier (LNA) 252. The received RF signal is amplified by LNA 252 and filtered by a filter 254 to obtain a desirable RF input signal. A downconverter 260 downconverts the RF input signal with I and Q receive (RX) LO signals from an RX LO signal generator 280 and provides I and Q baseband signals. The I and Q baseband signals are amplified by amplifiers 262*a* and 262*b* and further filtered by lowpass filters 264*a* and 264*b* to obtain I and Q analog input signals, which are provided to data processor 210. In the exemplary embodiment shown, the data processor 210 includes analog-to-digital-converters (ADC's) 216*a* and 216*b* for converting the analog input signals into digital signals to be further processed by the data processor 210.

TX LO signal generator 290 generates the I and Q TX LO signals used for frequency upconversion. RX LO signal generator 280 generates the I and Q RX LO signals used for frequency downconversion. Each LO signal is a periodic signal with a particular fundamental frequency. A PLL 292 receives timing information from data processor 210 and generates a control signal used to adjust the frequency and/or phase of the TX LO signals from LO signal generator 290. Similarly, a PLL 282 receives timing information from data processor 210 and generates a control signal used to adjust the frequency and/or phase of the RX LO signals from LO signal generator 280.

The data processor 210 further includes a baseband processing module 201 configured to process RX data from the ADC's 216*a*, 216*b*, and further to process TX data to the DAC's 214*a*, 214*b*. The baseband processing module 201 is further coupled to an audio codec 202. The module 201 may transmit digital signals to the audio codec 202 for output as an analog audio signal, and may further receive digital signals from the audio codec 202 corresponding to audio input signals. The audio codec 202 may further interface with audio signals to and from a headset (not shown in FIG. 2). In an exemplary embodiment, the techniques of the present disclosure may be implemented, e.g., within the baseband processing module 201, the audio codec 202, or using other digital or analog processing elements not shown in FIG. 2.

Figure 3:
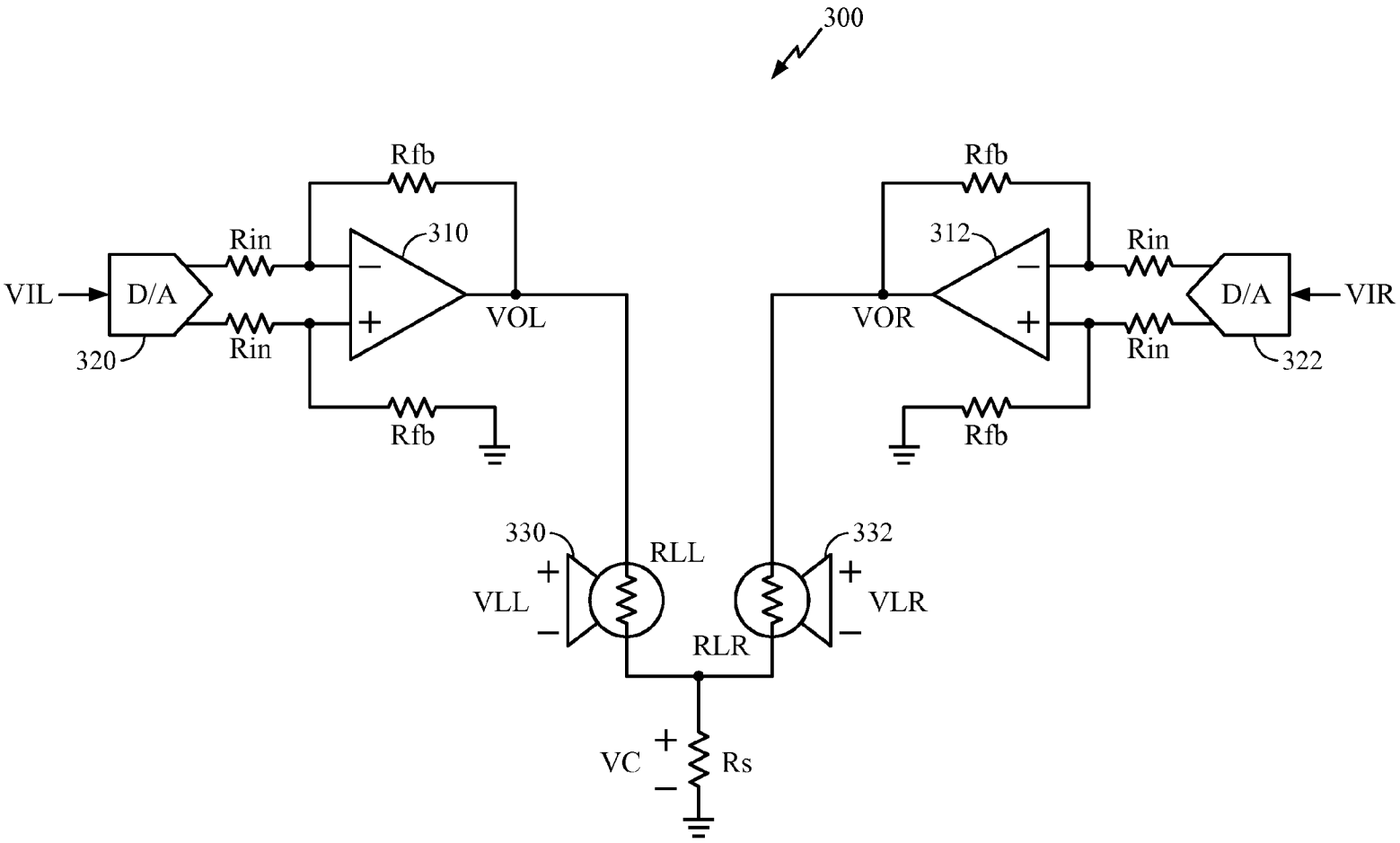
PRIOR ART FIG 3
FIG. 3 illustrates a prior art scheme for driving an audio system, illustrating certain aspects of the present disclosure.

FIG. 3 illustrates a prior art scheme for driving an audio system 100 such as shown in FIG. 1, illustrating certain aspects of the present disclosure. In FIG. 3, left and right channel digital input signals VIL, VIR are provided to corresponding digital-to-analog converters (DAC's) 320, 322. Note the digital input signals VIL, VIR may correspond to, e.g., signals digitally processed and generated by, e.g., a codec, as is known in the art.

In this specification and in the claims, the terms "left" and "right" may be used in the context of a stereo audio system having left and right audio channels. However, one of ordinary skill in the art will appreciate that the techniques described herein need not be limited to applications in an audio system, and may generally be applied to any systems wherein first and second amplifiers drive loads that share a common series path resistance. In such exemplary non-audio embodiments, it will be understood that the terms "first" and "second" may generally be substituted for the terms "left" and "right" (or "right" and "left") herein, and operating principles described herein may be correspondingly applied. Furthermore, while reference may be made to "audio" amplifiers, it will be appreciated that the techniques disclosed herein may also be applied to non-audio amplifiers in general. All such alternative exemplary embodiments are contemplated to be within the scope of the present disclosure.

The outputs of DAC's 320, 322 are coupled to the inputs of analog amplifiers (or op amp's) 310, 312 via input resistances Rin. It will be appreciated that in certain implementations, a DAC and an amplifier may generally be implemented as one block; for example, the resistors Rin can be an array of resistors implementing a DAC. The amplifiers 310, 312 are configured with corresponding feedback resistors Rfb, according to principles known to one of ordinary skill in the art. The voltage outputs of amplifiers 310, 312 are denoted as VOL, VOR, respectively, and are coupled to audio loads 330, 332 having load resistances RLL, RLR, respectively. The audio loads 330, 332 may correspond to, e.g., audio speakers or headphones, such as the L and R headphones 115, 120 in FIG. 1. The voltages across the load resistances RLL, RLR are also denoted VLL, VLR, respectively.

The audio loads 330, 332 are coupled to a common ground voltage via a source (or common) resistance Rs, the voltage drop across which is denoted VC. It will be appreciated that Rs may correspond to certain parasitic resistances that may be present in the audio system 300, e.g., arising from series resistance of the conductive leads of a headset, on-resistance of switches used to couple the terminals of a headset to appropriate driving terminals in a jack, etc. Since a portion of each driving voltage VOL, VOR will appear across the common resistance Rs, and further since each of the load voltages VLL, VLR are referenced to VC, it will be appreciated that the left load voltage VLL will contain a component attributable to the right-channel driving voltage VOR, and vice versa. This phenomenon is known as "crosstalk," and its presence undesirably degrades the signal fidelity of the audio system 300.

In particular, the crosstalk in the system 300 may be quantified as follows (Equation 1a):

$$VC = \frac{Rs \| RL}{RL + Rs \| RL}(VIR + VIL) = x(VIR + VIL);$$

wherein (Equation 1b):

$$x = \frac{Rs}{RL + 2Rs};$$

and it is assumed that the left and right load resistances are equal to RL, i.e., RL=RLL=RLR. From Equation 1a, the left load voltage VLL may be expressed as follows (Equation 1c):

$$VLL = VOL - VC = (1-x)VIL - x \cdot VIR.$$

In light of the equations above, it will be appreciated that the right channel voltage VIR will cross-couple into the left load voltage VLL by a cross-coupling factor x. It will be appreciated that, as the system is symmetric between the left and right channels, similar equations may also derived for VLR, e.g., showing that the left channel voltage VIL will cross-couple into the right load voltage VLR by a cross-coupling factor x. In an aspect of the present disclosure, it would be desirable to provide simple and efficient techniques for removing crosstalk from the left and right channels of an audio system, as further described hereinbelow.

Figure 4:
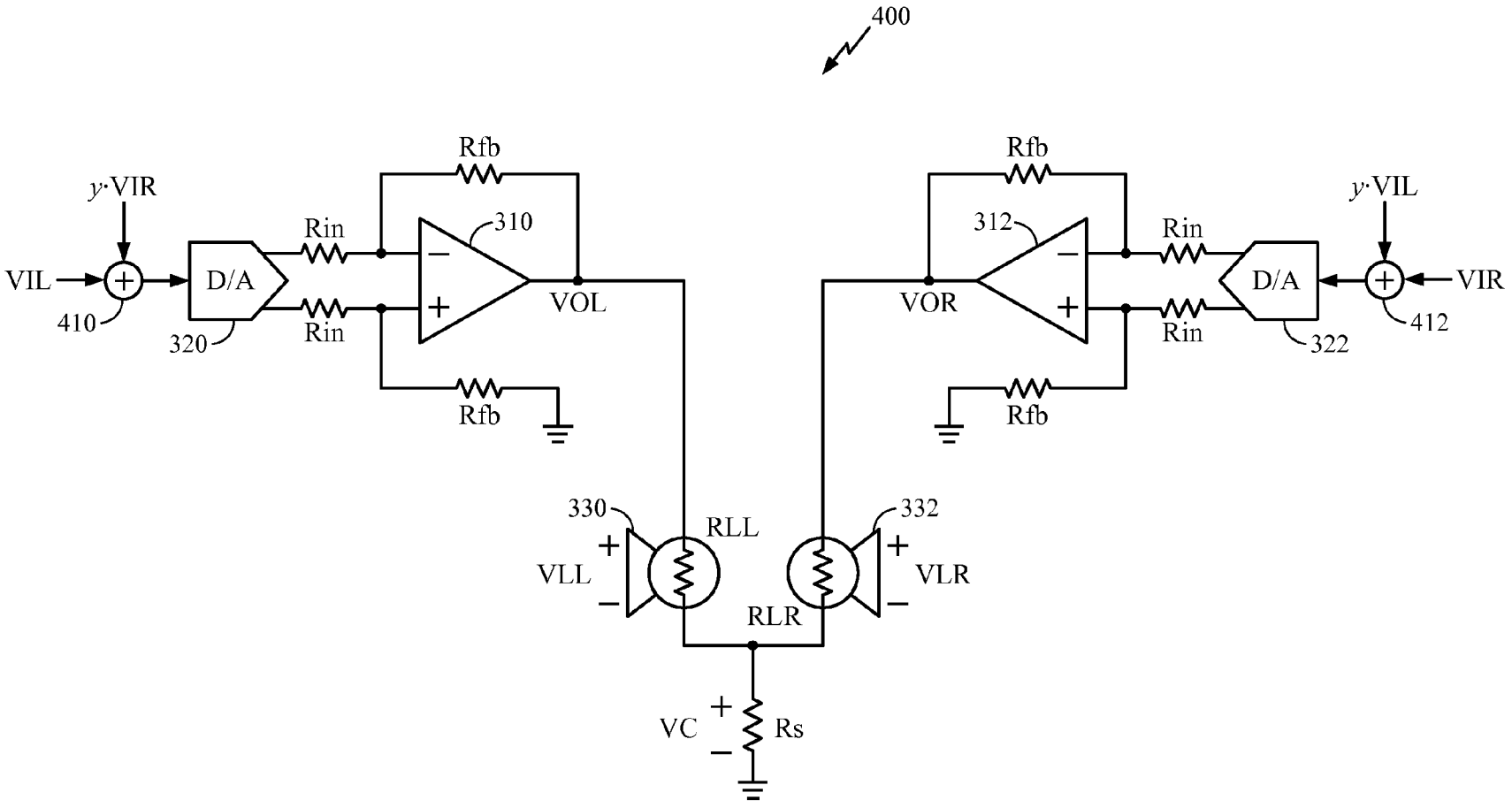
FIG. 4 illustrates an exemplary embodiment of the present disclosure.

FIG. 4 illustrates an exemplary embodiment 400 of the present disclosure. Note FIG. 4 is shown for illustrative purposes only, and is not meant to limit the scope of the present disclosure to any particular exemplary embodiment shown. In FIGS. 3 and 4, similarly labeled elements may correspond to elements having similar functionality, unless otherwise noted.

In FIG. 4, a digital adder 410 is provided prior to the DAC 320, and is configured to add the left input voltage VIL with a crosstalk removal function y times the right input voltage VIR. Similarly, a digital adder 412 is provided prior to the DAC 322 to add the right input voltage VIR with the function y times the left input voltage VIL. In an exemplary embodiment, to remove crosstalk at the left and right audio loads, the crosstalk removal function y may be specified in the particular manner described hereinbelow.

In particular, a constant function y may be defined as follows (Equation 2a):

$$y = \frac{x}{1-x} = \frac{Rs}{RL + Rs}.$$

The left load voltage VLL in FIG. 4 may then be expressed as follows (Equations 2b):

$$\begin{aligned} VLL &= VOL - VC; \\ &= (1-x)(VIL + y \cdot VIR) - x(VIR + y \cdot VIL); \\ &= \frac{1-2x}{1-x} VIL. \end{aligned}$$

From the above equations, it will be appreciated that crosstalk may theoretically be removed from VLL (and similarly from VLR) by increasing each channel's digital input voltage by the other channel's digital input voltage times y. In particular, the inputs to the adders 410, 412 in FIG. 4 may be set as y·VIR and y·VIL, respectively.

While the exemplary embodiment 400 shown incorporates digital adders 410, 412, it will be appreciated that alternative exemplary embodiments (not shown) may incorporate adders in the analog domain for performing the functions described. For example, analog adders may be incorporated following the D/A converters 320, 322 to add functions of y·VOR, y·VOL to the corresponding analog driving voltages. Such alternative exemplary embodiments are contemplated to be within the scope of the present disclosure.

Figure 5:
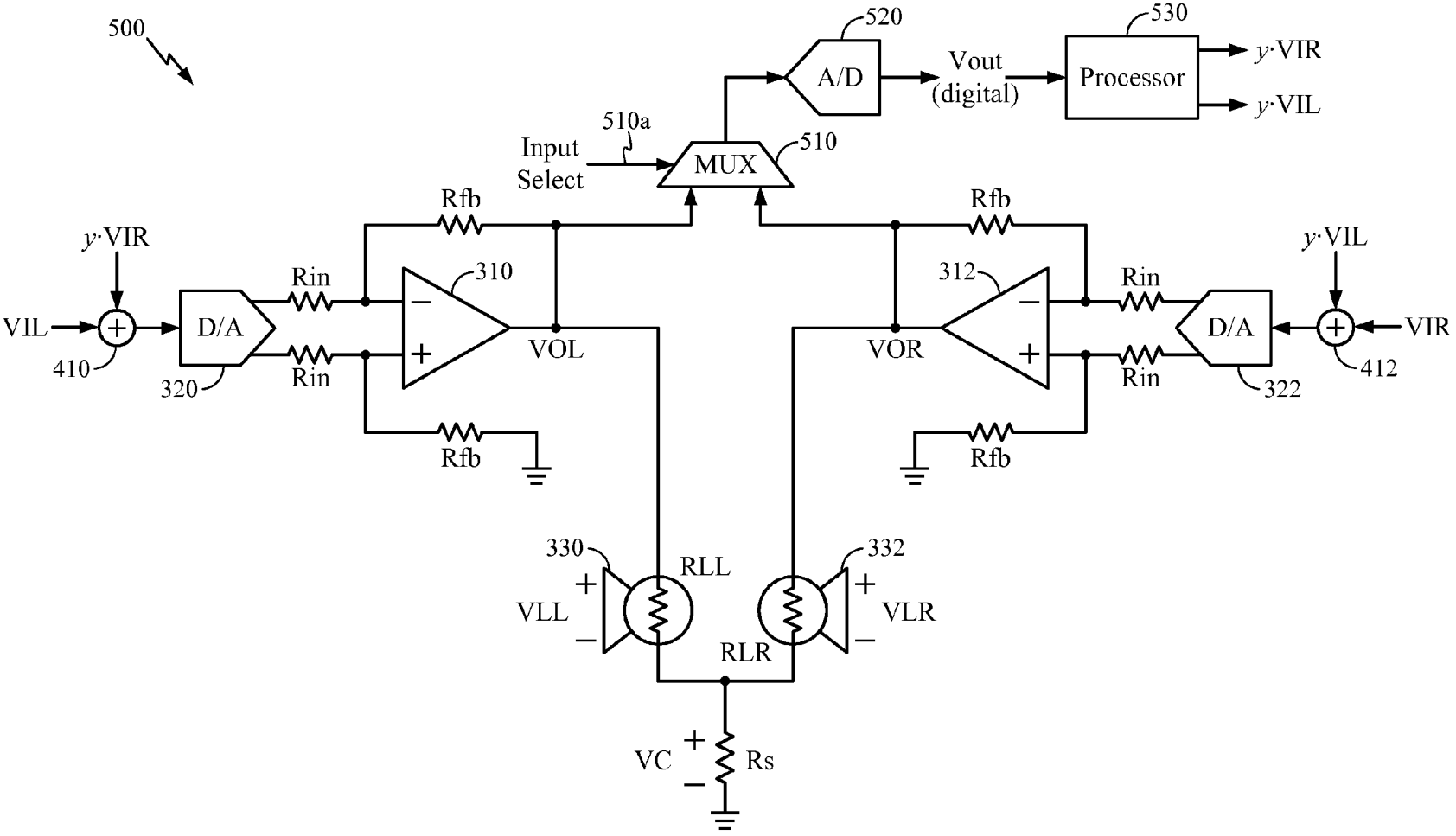
FIG. 5 illustrates an exemplary embodiment of an architecture that may be employed to calculate the constant y, when the load resistance RL is unknown.

FIG. 5 illustrates an exemplary embodiment of an architecture 500 that may be employed to calculate the constant y, when the load resistance RL is unknown. Note FIG. 5 is shown for illustrative purposes only, and is not meant to limit the scope of the present disclosure to any particular technique for deriving RL or y. In FIGS. 4 and 5, similarly labeled elements may correspond to elements having similar functionality, unless otherwise noted.

In FIG. 5, the voltages VOL and VOR are coupled to the inputs of a multiplexer 510, whose output is selected from between VOL and VOR by a control signal "Input select" 510*a*. The output of the multiplexer 510 is coupled to an analog-to-digital converter (ADC) 520, which generates a digital version Vout of the multiplexer output. Vout is further coupled to a processor 530, which further computes the value of y, and/or y·VIR and y·VIL, according to techniques further described hereinbelow. It will be appreciated that in certain exemplary embodiments, the functions implemented by the processor 530 may be performed by, e.g., any of the modules in the data processor 210 of FIG. 2, such as the baseband processing module 201, or the audio codec 202, or other modules not explicitly shown in FIG. 2. The functions implemented by the processor 530 may also be performed using off-chip circuitry separate from the data processor 210. All such alternative exemplary embodiments are contemplated to be within the scope of the present disclosure.

Figure 6:
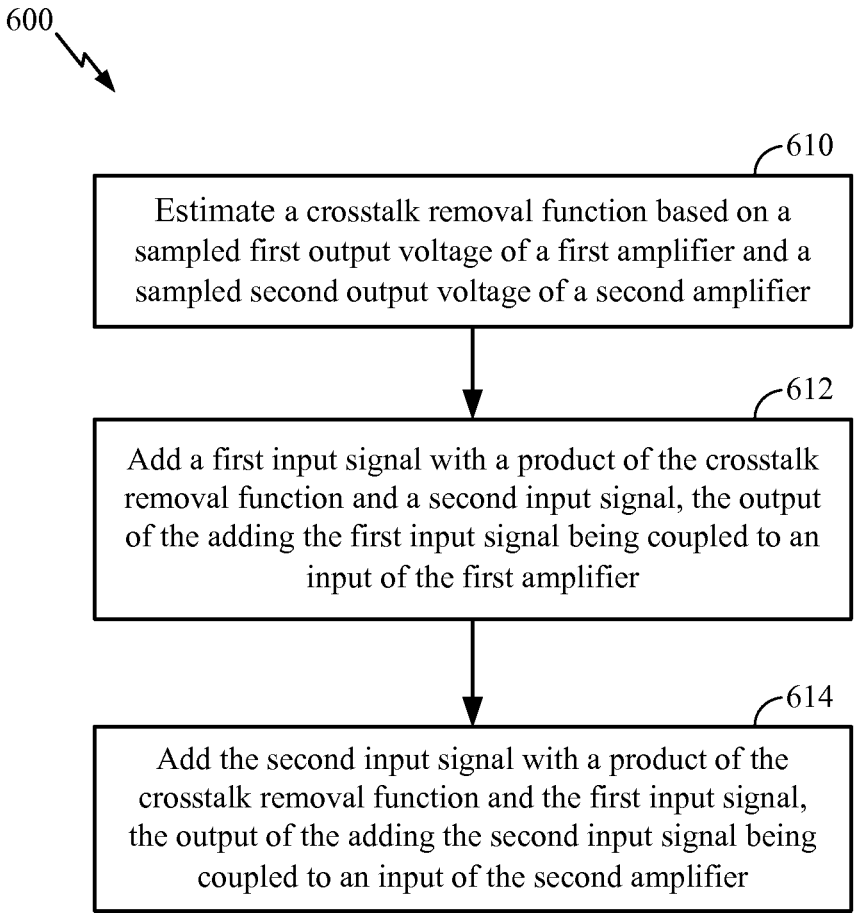
FIGS. 6, 6A, and 6B illustrate exemplary embodiments of methods for determining the correct value of y to achieve crosstalk removal according to the present disclosure.
Figure 6A:
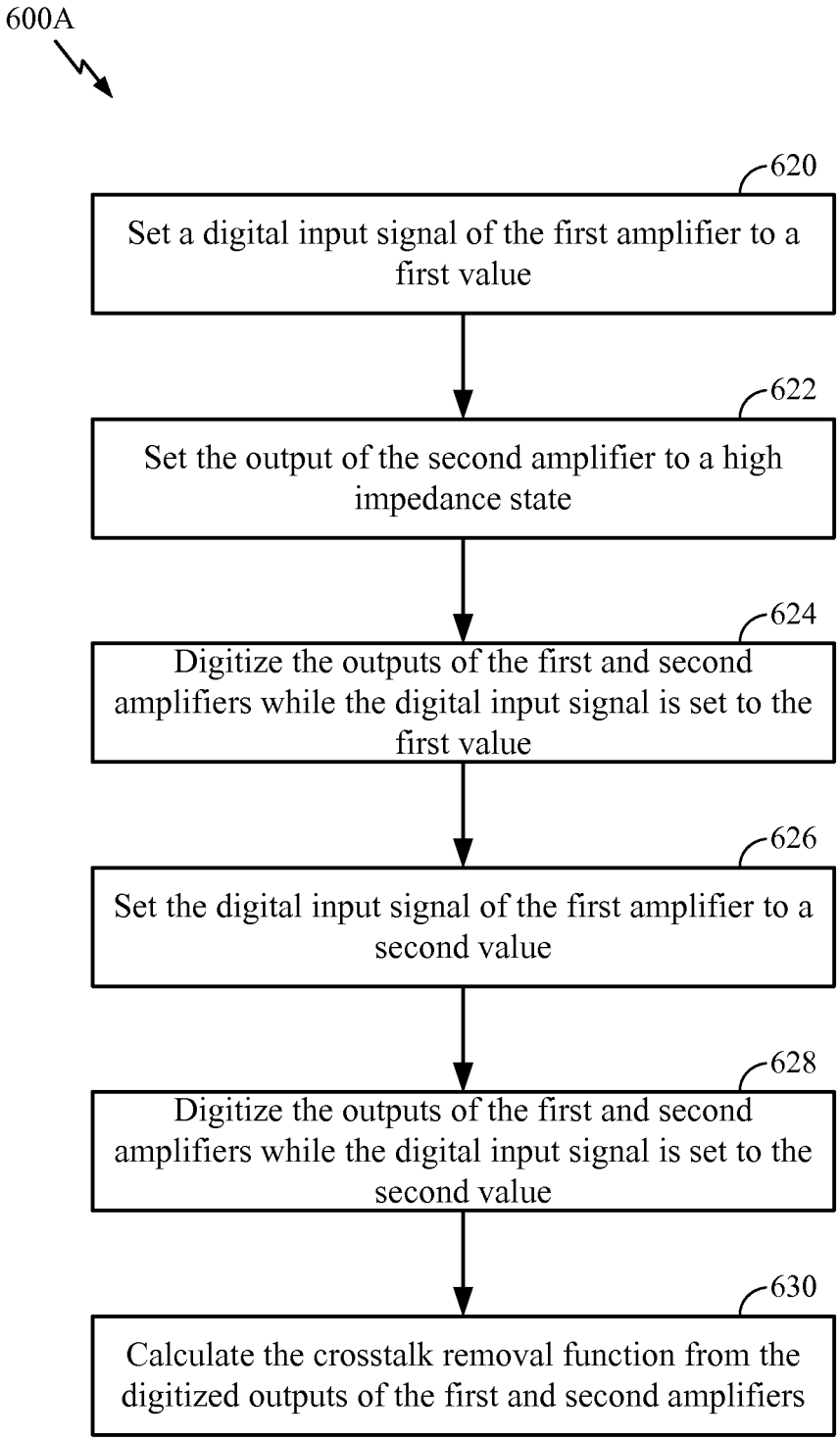
Figure 6B:
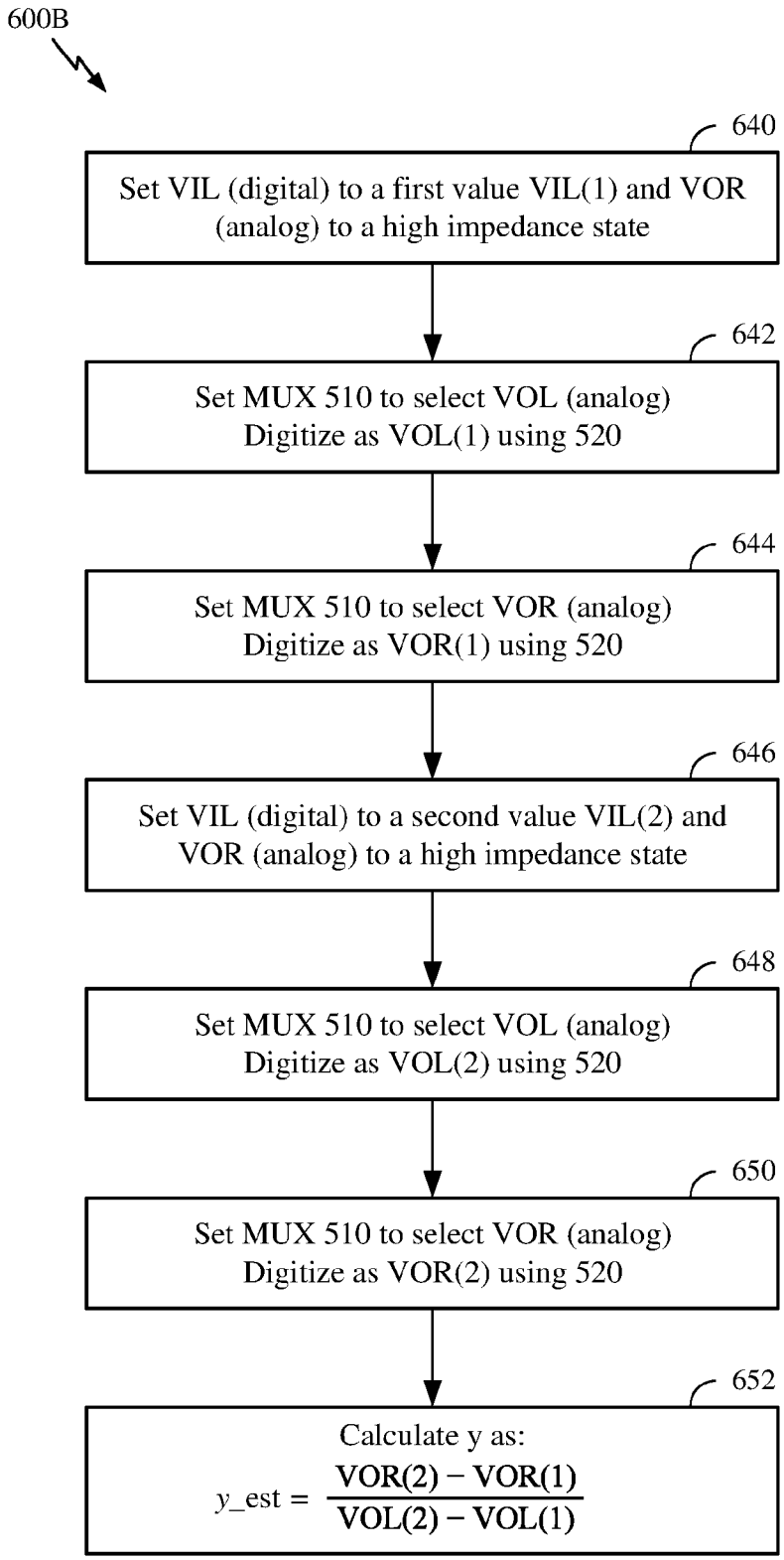

FIGS. 6, 6A, and 6B illustrate an exemplary embodiment of methods 600, 600A, and 600B for determining the correct value of y using the architecture 500 to achieve crosstalk removal according to the present disclosure. The functionality shown in FIGS. 6, 6A, and 6B may be implemented, e.g., using the architecture 500 shown in FIG. 5, with reference to elements described with reference to FIG. 5, during a calibration mode of the system. Note FIGS. 6, 6A, and 6B are shown for illustrative purposes only, and are not meant to limit the scope of the present disclosure to any particular methods shown.

In FIG. 6, at block 610, a crosstalk removal function is estimated based on a sampled first output voltage of a first amplifier and a sampled second output voltage of a second amplifier.

At block 612, a first input signal is added with a product of the crosstalk removal function and a second input signal. The output of the adding the first input signal is coupled to an input of the first amplifier.

At block 614, the second input signal is added with a product of the crosstalk removal function and the first input signal. The output of the adding the second input signal is coupled to an input of the second amplifier.

FIG. 6A illustrates a method 600A based on FIG. 6, wherein further operations are performed to compute the crosstalk removal function. Note FIG. 6A may incorporate the operations described with reference to FIG. 6.

In particular, in FIG. 6A, at block 620, a digital input signal of the first amplifier is set to a first value.

At block 622, the output of the second amplifier is set to a high impedance state.

At block 624, the outputs of the first and second amplifiers are digitized while the digital input signal is set to the first value.

At block 626, the digital input signal of the first amplifier is set to a second value.

At block 628, the outputs of the first and second amplifiers are digitized while the digital input signal is set to the second value.

At block 630, the crosstalk removal function is calculated from the digitized outputs of the first and second amplifiers. Note block 630 may correspond to a specific manner in which the crosstalk removal function is estimated, as described at block 610 in FIG. 6.

FIG. 6B illustrates a method 600B based on FIG. 6A, wherein the operations are applied to an audio system having left and right channels. Note certain signals shown in FIG. 5 are referenced hereinbelow in the description of FIG. 6B.

In particular, in FIG. 6B, at block 640, VIL is set to a first digital value VIL(1), while the node corresponding to voltage VOR is set to a high impedance state. In an exemplary embodiment, this may correspond to, e.g., disabling the output of the op amp 312 using a control signal (not shown in FIG. 5). Note at block 640, the term y·VIR added by adder 410 may be set to zero during the calibration mode.

It will be appreciated that following block 640, an analog voltage VOL will be present at the output of op amp 310, corresponding to the analog version of digital input signal VIL(1). Furthermore, an analog voltage VOR will be present at the output of op amp 312, corresponding to the expected voltage division of VOL by series resistances RLL and Rs.

At block 642, the multiplexer 510 is configured to select the analog voltage VOL as the input. Further at block 642, the ADC 520 digitizes VOL to generate a digital version of VOL, or VOL_d(1), corresponding to the first digital input signal VIL(1).

At block 644, the multiplexer 510 is configured to select the analog voltage VOR as the input. Further at block 644, the ADC 520 digitizes VOR to generate a digital version of VOR, or VOR_d(1), also corresponding to the first digital input signal VIL(1).

In this specification and the claims, VOL(1) and VOR(1) may also be referred to as the first-iteration first and second output voltages.

One of ordinary skill in the art will appreciate that blocks 642, 644 are generally inter-changeable in sequence, and such alternative exemplary embodiments are contemplated to be within the scope of the present disclosure.

In an exemplary embodiment, VOL_d(1) and VOR_d(1) may be stored in a digital memory (not shown) for later retrieval and processing.

At block 646, VIL is set to a second digital value VIL(2), while the node corresponding to voltage VOR is again set to a high impedance state. Note at block 646, the term y·VIR added by adder 410 may be set to zero.

At block 648, the multiplexer 510 is configured to select the analog voltage VOL as the input. Further at block 648, the ADC 520 digitizes VOL to generate a digital version of VOL, or VOL_d(2), corresponding to the second digital input signal VIL(2).

At block 650, the multiplexer 510 is configured to select the analog voltage VOR as the input. Further at block 650, the ADC 520 digitizes VOR to generate a digital version of VOR, or VOR_d(2), also corresponding to the second digital input signal VIL(2).

In this specification and the claims, VOL(2) and VOR(2) may also be referred to as the second-iteration first and second output voltages.

One of ordinary skill in the art will appreciate that blocks 648, 650 are generally inter-changeable in sequence, and such alternative exemplary embodiments are contemplated to be within the scope of the present disclosure.

In an exemplary embodiment, VOL_d(2) and VOR_d(2) may also be stored in a digital memory for later retrieval and processing.

At block 652, the constant y may be estimated as follows (Equation 3):

$$y_est = \frac{VOR_d(2) - VOR_d(1)}{VOL_d(2) - VOL_d(1)};$$

wherein y_est corresponds to the estimated value of y, and the values VOL_d( ) and VOR_d( ) may be retrieved from memory, as earlier described herein. In an exemplary embodiment, the processor 530 may be configured to perform this calculation.

Following computation of Equation 3, calibration mode may be turned off, and the computed value y_est may be used as y to compute the terms y·VIR and y·VIL. As previously described hereinabove, these terms may be provided to the adders 410, 412, during normal operation to accordingly remove crosstalk from the system.

It will be appreciated that two-point measurement (i.e., setting two distinct values of VIL, as at blocks 640 and 646 of FIG. 6B) as shown in FIG. 6B advantageously corrects for non-ideal offsets arising from components such as the D/A converter 320, amplifier 310, etc. In alternative exemplary embodiments (not shown), more than two data points may be obtained to compute y_est, e.g., using estimation techniques such as least squares, filtering, averaging, etc. Such alternative exemplary embodiments are contemplated to be within the scope of the present disclosure.

One of ordinary skill in the art will appreciate that while the method 600B of FIG. 6B has been described with reference to setting digital values for the left-channel input signal VIL and setting the node corresponding to VOR to have high impedance, in alternative exemplary embodiments, digital values may instead be set for the right-channel input signal VIR, and the node corresponding to VOL may be set instead to have high impedance, due to the symmetry of the system. In certain exemplary embodiments, following the execution of blocks 640 through 650 by setting the left-channel input signal VIL, blocks 640 through 650 may be repeated once more, this time setting digital values for the right-channel input signal VIR and setting VOL to have high impedance. In this case, the estimate y_est for y may be computed using, e.g., four (i.e., VIL(1), VIL(2), VIR(1), VIR(2)) data points rather than two. Such alternative exemplary embodiments are contemplated to be within the scope of the present disclosure.

It will also be appreciated that the techniques of the present disclosure need not be limited to multi-point measurements, and in alternative exemplary embodiments, one-point measurement may also be employed. For example, referring to FIG. 6B, VOL(1) and VOR(1) corresponding to a single setting of VIL(1) may be used to directly estimate y, without further obtaining the values VOL(2), VOR(2) corresponding to VIL(2). In this case, blocks 646, 648, 650 may be omitted, and block 652 may be altered such that y is estimated directly from VOL(1) and VOR(1), e.g., as VOR(1)/VOL(1). Such alternative exemplary embodiments are contemplated to be within the scope of the present disclosure.

Figure 7:
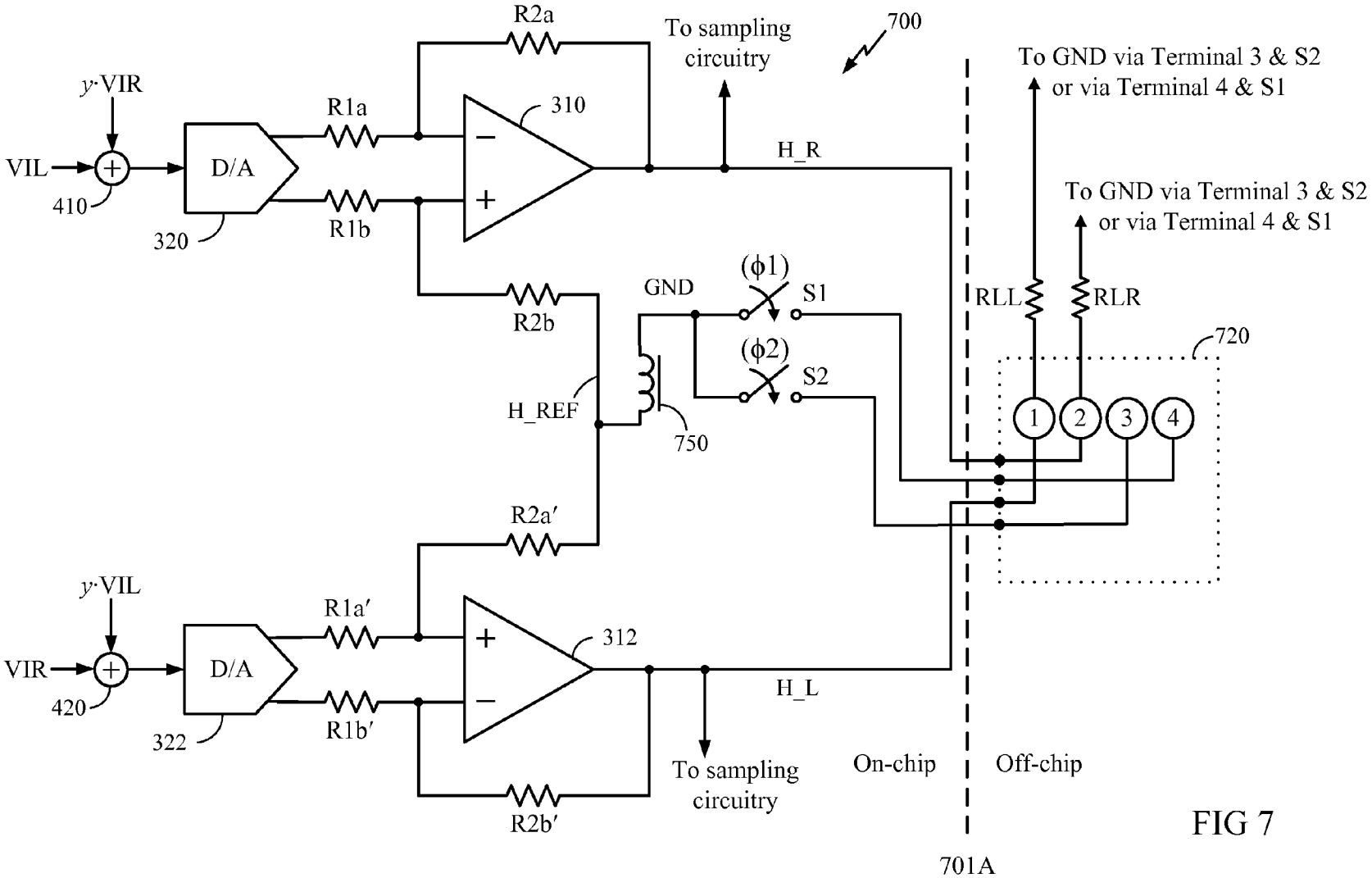
FIG. 7 illustrates an exemplary embodiment of the present disclosure, wherein the techniques disclosed herein are integrated with further features according to the present disclosure.

FIG. 7 illustrates an exemplary embodiment of the present disclosure, wherein the techniques disclosed herein are integrated with further features. Note FIG. 7 is shown for illustrative purposes only, and is not meant to limit the scope of the present disclosure to exemplary embodiments having any or all of the features shown in FIG. 7. Note similarly labeled elements in FIGS. 5 and 7 may correspond to elements having similar functionality, unless otherwise noted. In FIG. 7, elements to the left side of a functional dividing line 701A may be understood as being provided on an integrated circuit (IC), i.e., "on-chip," while elements to the right of 701A may be understood as being provided externally from the IC, i.e., "off-chip." Note however that 701A is not meant to limit the scope of the present disclosure to particular exemplary embodiments employing the on-chip/off-chip divisions shown, and alternative exemplary embodiments may readily employ other functional partitioning not shown in FIG. 7. Such alternative exemplary embodiments are contemplated to be within the scope of the present disclosure.

In FIG. 7, the outputs of op amps 310 and 312 are coupled to terminals 1 and 2, respectively, of a jack 720. It will be appreciated that the jack 720 may be provided to receive an audio plug (not shown) electrically coupled to left and right audio loads, modeled as load resistances RLL and RLR in FIG. 7. In FIG. 7, jack terminals 3 and 4 are further selectively coupled to a ground (GND) connection via switches S1 and S2, configured by control signals $\phi$1, $\phi$2. In an exemplary embodiment, S1 and S2 are configured to couple either jack terminal 3 or 4 to GND, depending on whether a plug inserted into the jack is of a European or a North American type. It will be appreciated that because of their placement in series with GND, the on-resistance of switch S1 or S2 may contribute to the common resistance Rs earlier referred to hereinabove, e.g., with reference to FIGS. 4 and 5. Note in addition to the switches S1 and S2, other switches (not shown in FIG. 7) may be provided to configure an audio jack to support either a European or North American plug type, e.g., switches for coupling either jack terminal 3 or 4 to a microphone (MIC) terminal (not shown) of a plug, etc. Further note that the switches S1 and S2 are shown in FIG. 7 for illustrative purposes only, and that alternative exemplary embodiments of the present disclosure may implement the feature of plug type-based reconfigurability in alternative ways not shown, e.g., using a different number of switches, or other switch configurations, etc. Such alternative exemplary embodiments are contemplated to be within the scope of the present disclosure.

The GND connection in FIG. 7 is further coupled to a headphone reference (H_REF) node via an inductor 750. In certain exemplary embodiments, it will be appreciated that the inductor 750 may provide electrical isolation of the audio circuitry shown in FIG. 7 from other circuitry, e.g., FM receive processing circuitry, not shown. In some cases, the inductor 750 may also contribute a component to the common resistance Rs earlier referred to hereinabove.

It will be appreciated that the crosstalk removal techniques disclosed herein may readily be applied to cancel the crosstalk arising from series resistance contributed by these aforementioned sources. For example, the outputs of op amps 310, 312 may be provided to the sampling circuitry, e.g., elements 510, 520, 530 shown in FIG. 5, to derive the crosstalk removal function y, in accordance with the techniques of the present disclosure. It will further be appreciated that in certain exemplary embodiments, the sources of series ground resistance shown in FIG. 7 need not all be present in a single device. For example, some exemplary embodiments may include only the ground switches S1, S2 without including the inductor 750, while other exemplary embodiments may include only the inductor 750 without the ground switches S1, S2, etc. Such alternative exemplary embodiments are contemplated to be within the scope of the present disclosure.

Figure 8:
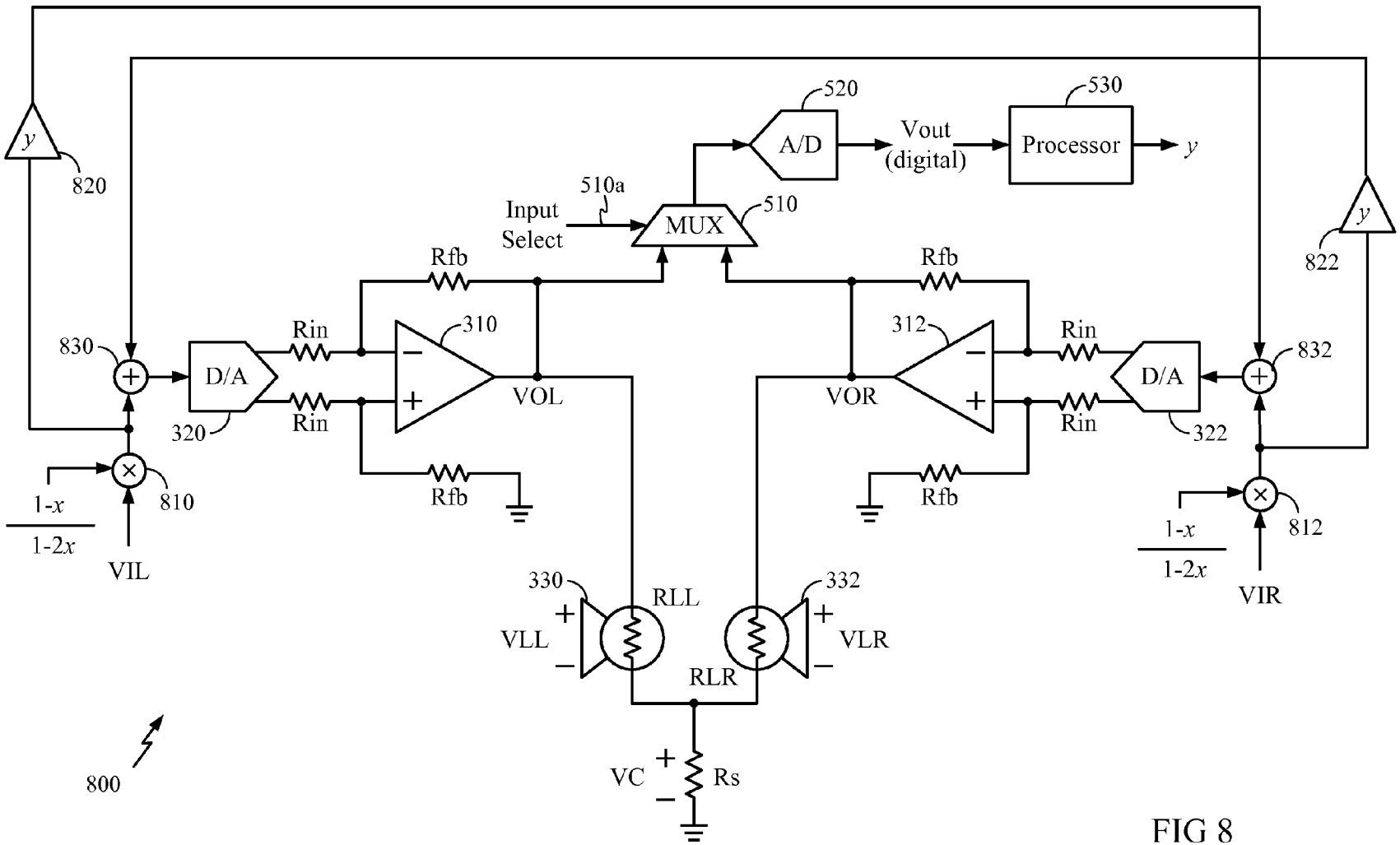
FIG. 8 illustrates an alternative exemplary embodiment of the present disclosure, wherein an additional gain correction factor is applied to the audio channels.

It will be appreciated that, in the exemplary embodiments shown in, e.g., FIGS. 5 and 8, the loads RLL and RLR are coupled via the common resistance Rs to the ground voltage, which serves as the common voltage reference. Accordingly, a negative voltage supply (not shown) may be additionally provided to power the op amps 310, 312, to allow the amplifier output voltages VOL, VOR to be negative with respect to ground if necessary. In certain cases, this implementation may be advantageous over other embodiments wherein a separate positive voltage (i.e., between ground and the positive voltage supply) is generated as the common voltage reference for the loads RLL and RLR, e.g., using a separate op amp (not shown) which may itself contribute additional common resistance Rs via its output path.

Note the techniques described hereinabove advantageously allow the crosstalk removal function y to be calculated by using the analog output voltages VOL, VOR, which, in practice, may be readily accessible on-chip as the output voltages of the left and right amplifiers. For example, as the amplifiers 310, 312 may be provided on a single integrated circuit with the sampling circuitry 510, 520, 530, etc., the output voltages VOR and VOL of those amplifiers may be directly routed on-chip to the sampling circuitry, without requiring external off-chip leads or board traces. In this manner, the present techniques do not require access to post-silicon information, e.g., other operational amplifier output impedance and/or measured routing impedance, to compute the crosstalk removal function y. It will further be appreciated that the crosstalk removal techniques disclosed herein may be readily combined with other crosstalk reduction/removal techniques not explicitly described herein to further enhance the performance of any system. Such alternative exemplary embodiments are contemplated to be within the scope of the present disclosure.

FIG. 8 illustrates an alternative exemplary embodiment of the present disclosure, wherein an additional gain correction factor is applied to the audio channels. Note FIG. 8 is shown for illustrative purpose only, and is not meant to limit the scope of the present disclosure. In alternative exemplary embodiments, the gain correction factors indicated in FIG. 8 need not be applied, and such alternative exemplary embodiments are contemplated to be within the scope of the present disclosure.

In FIG. 8, using multipliers 810, 812, a multiplicative gain of 1-x/1-2x is applied to VIL, VIR prior to addition by adders 830, 832. Furthermore, adder 830 adds the output of multiplier 810 with the crosstalk removal function y times the output of multiplier 812, while adder 832 adds the output of multiplier 812 with the crosstalk removal function y times the output of multiplier 810, with gain elements 820, 822 applying multiplicative gains in the indicated manner. It will be appreciated that these operations advantageously correct for any gain errors introduced by the crosstalk removal techniques described herein, such as may be indicated by inspection of Equations 2b hereinabove.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Furthermore, when an element is referred to as being "electrically coupled" to another element, it denotes that a path of low resistance, or an electrical short circuit, is present between such elements, while when an element is referred to as being simply "coupled" to another element, there may or may not be a path of low resistance between such elements.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill in the art would further appreciate that the various illustrative logical blocks, modules, circuits, and algorithm steps described in connection with the exemplary aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary aspects of the invention.

The various illustrative logical blocks, modules, and circuits described in connection with the exemplary aspects disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the exemplary aspects disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary aspects, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-Ray disc where disks usually reproduce data magnetically, while discs reproduce data optically with lasers. Combinations of the above should also be included within the scope of computer-readable media.

The previous description of the disclosed exemplary aspects is provided to enable any person skilled in the art to make or use the invention. Various modifications to these exemplary aspects will be readily apparent to those skilled in the art, and the generic principles defined herein may be applied to other exemplary aspects without departing from the spirit or scope of the invention. Thus, the present disclosure is not intended to be limited to the exemplary aspects shown herein but is to be accorded the widest scope consistent with the principles and novel features disclosed herein.

The invention claimed is:

1. An apparatus with a first amplifier and a second amplifier, further comprising:

a first adder configured to add a first input signal with a product of a crosstalk removal function and a second input signal, wherein the crosstalk removal function is estimated based on a plurality of sampled first output voltages of the first amplifier and a plurality of sampled second output voltages of the second amplifier, an output of the first adder being coupled to an input of the first amplifier; and a second adder configured to add the second input signal with a product of the crosstalk removal function and the first input signal, the output of the second adder being coupled to an input of the second amplifier.

2. The apparatus of claim 1, wherein the first adder is a left adder, the first input signal is a left audio input signal, the first amplifier is a left audio amplifier, the second adder is a right adder, the second input signal is a right audio input signal, and the second amplifier is a right audio amplifier.

3. The apparatus of claim 1, further comprising a processor configured to estimate the crosstalk removal function based on the plurality of sampled first output voltages and the plurality of sampled second output voltages.

4. The apparatus of claim 3, the processor further configured to:

configure one of the first and second amplifiers to be driven with a first voltage V1 while the output of another one of the first and second amplifiers is configured to have high impedance;

sample first-iteration first and second output voltages VOL(1), VOR(1) while driving with the first voltage V1;

configure one of the first and second amplifiers to be driven with a second voltage V2 distinct from V1 while the output of another one of the first and second amplifiers is configured to have high impedance; and sample second-iteration first and second output voltages VOL(2), VOR(2) while driving with the second voltage V2.

5. The apparatus of claim 4, the processor further configured to estimate the crosstalk removal function as a function of [VOR(2)−VOR(1)]/[VOL(2)−VOL(1)] or [VOR(2)−VOR(1)]/[VOL(2)−VOL(1)].

6. The apparatus of claim 4, the processor further configured to:

configure one of the first and second amplifiers to be driven with a third voltage V3 distinct from V1 and V2 while the output of another one of the first and second amplifiers is configured to have high impedance; and sample third-iteration first and second output voltages VOL(3), VOR(3) while driving with the third voltage V3.

7. The apparatus of claim 3, further comprising a multiplexer configured to generate an output signal from selecting between the first output voltage and the second output voltage in response to a control signal generated by the processor.

8. The apparatus of claim 1, the first and second adders being digital adders, the outputs of the adders coupled to digital-to-analog converters for generating analog signals, the analog signals coupled to the inputs of the first and second amplifiers.

9. The apparatus of claim 1, further comprising the first amplifier and the second amplifier, the apparatus further comprising:

at least one switch for selectively coupling a ground node to a jack terminal; and an inductor coupling the ground node to a reference terminal, the reference terminal coupled to input terminals of the first and second amplifiers.

10. The apparatus of claim 1, further comprising:

a first multiplication element configured to scale the first input signal with a gain adjustment factor prior to the first adder; and a second multiplication element configured to scale the second input signal with a gain adjustment factor prior to the second adder.

11. An apparatus with a first amplifier and a second amplifier, further comprising:

means for sampling a first output voltage coupled to a first amplifier output of the first amplifier, and for sampling a second output voltage coupled to a second amplifier output of the second amplifier;

means for estimating a crosstalk removal function based on a plurality of sampled first voltages and a plurality of sampled second output voltages; and means for adding a first input signal with a product of the crosstalk removal function and a second input signal, and for adding the second input signal with a product of the crosstalk removal function and the first input signal.

12. The apparatus of claim 11, further comprising:

means for configuring one of the first and second amplifiers to be driven with a first voltage V1 while configuring the output of another one of the first and second amplifiers to have high impedance;

means for sampling the outputs of the amplifiers while driving each amplifier with the first voltage V1.

13. The apparatus of claim 12, wherein the outputs of the amplifiers are sampled while the first amplifier is driven with the first voltage V1, and the outputs of the amplifiers are sampled while the second amplifier is driven with a second voltage V2.

14. The apparatus of claim 11, further comprising:

means for converting the first and second output voltages to digital values prior to providing to the means for sampling.

15. The apparatus of claim 11, the means for sampling comprising means for selecting from between the first and second output voltages in response to a control signal.

16. A method comprising:

estimating a crosstalk removal function based on a plurality of sampled first output voltages of a first amplifier and a plurality of sampled second output voltages of a second amplifier;

adding a first input signal with a product of the crosstalk removal function and a second input signal, an output of the adding the first input signal being coupled to an input of the first amplifier; and adding the second input signal with a product of the crosstalk removal function and the first input signal, an output of the adding the second input signal being coupled to an input of the second amplifier.

17. The method of claim 16, further comprising:

setting a digital input signal of the first amplifier to a first value;

setting the output of the second amplifier to a high impedance state;

digitizing the outputs of the first and second amplifiers while the digital input signal is set to the first value;

setting the digital input signal of the first amplifier to a second value; and digitizing the outputs of the first and second amplifiers while the digital input signal is set to the second value; the estimating the crosstalk removal function comprising calculating the crosstalk removal function from the digitized outputs of the first and second amplifiers.

18. The method of claim 17, wherein the calculating comprises dividing a difference between the outputs of the second amplifier when the digital input signal is set to the first and second values, by a difference between the outputs of the first amplifier when the digital input is set to the first and second values.

19. The method of claim 16, wherein the first input signal is a left audio input signal, the first amplifier is a left audio amplifier, the second input signal is a right audio input signal, the second amplifier is a right audio amplifier.

20. The method of claim 16, further comprising:

selecting between the first and second output voltages for digitization in response to a control signal.

* * * * *